US006082815A

United States Patent [19]

Xiromeritis et al.

[11] Patent Number: 6,082,815

[45] Date of Patent: Jul. 4, 2000

[54] VEHICLE SEAT ASSEMBLY WITH MULTIPLE AXIS PIVOTING TRAY TABLE

[75] Inventors: Nick G. Xiromeritis; Susan M. Kennedy, both of Holland; Neil J. Bush, Grand Rapids; Jay M. Frankhouse, Holland, all of Mich.

[73] Assignee: Johnson Controls Technology Company, Plymouth, Mich.

[21] Appl. No.: 09/220,214

[22] Filed: Dec. 23, 1998

[51] Int. Cl.[7] ..... A47C 7/62

[52] U.S. Cl. ..... 297/124; 297/146; 297/173; 297/188.04

[58] Field of Search ..... 297/124–126, 297/146, 154, 156, 173, 174, 188.04, 188.05, 188.07

[56] References Cited

U.S. PATENT DOCUMENTS

| | | | |
|---|---|---|---|
| 3,877,747 | 4/1975 | Brennan et al. | 297/124 |
| 4,311,461 | 1/1982 | Hotta et al. | 297/188.05 X |
| 4,536,027 | 8/1985 | Brennan | 297/124 |
| 5,000,511 | 3/1991 | Shichijo et al. | 297/217.3 |
| 5,037,157 | 8/1991 | Wain et al. | 297/124 X |
| 5,133,587 | 7/1992 | Hadden, Jr. | 297/146 |
| 5,547,247 | 8/1996 | Dixon . | |

*Primary Examiner*—Peter R. Brown
*Attorney, Agent, or Firm*—Harness, Dickey & Pierce, P.L.C.

[57] ABSTRACT

A tray table for a vehicle seat assembly which has a stowed position within the seat back in which the tray table forms a portion of the seat back seating surface. The tray table is mounted to the frame structure of the seat assembly by a multiple axis pivot mount to rotate first to a generally horizontal position in which it extends forward from the seat back. The pivot mount enables the tray table to then rotate about an upright axis to swing the tray table laterally toward an adjacent seat assembly. The pivot mount is located along one side edge of the tray table such that the tray table is cantilever supported to the seat back.

27 Claims, 3 Drawing Sheets

VEHICLE SEAT ASSEMBLY WITH MULTIPLE AXIS PIVOTING TRAY TABLE

BACKGROUND OF THE INVENTION

The present invention relates to a vehicle seat assembly and in particular to a seat assembly having a tray table which is supported by a multiple axis pivot mount.

Vehicle manufacturers are continually striving to provide additional convenience features in their products. One way to do this is to provide features in the vehicle interior that enable the vehicle operator greater convenience and flexibility in using the vehicle. This is particularly important for persons who use their vehicles on business travel and are thus in their vehicles for extended times and may be working in the vehicle while stopped. One convenience feature that is useful for persons conducting business in the vehicle is a tray table that can be used as a writing or support surface. Such a tray table is commonly found in airplane seating where the tray table is mounted to the back of a seat assembly and rotates rearward to provide a horizontal surface for the occupant of the next rearward seat assembly. Tray tables are generally not available in automobiles, trucks, sport utility vehicles, etc.

Accordingly, a need exists for a tray table in an automotive seat assembly which can be used by a front seat occupant, including the vehicle driver.

SUMMARY OF THE INVENTION

The present invention provides a seat assembly with a tray table that is cantilever supported to the seat assembly and which rotates about multiple axes. In one embodiment, the tray table is mounted to the seat back of a front row passenger-side seat assembly. The tray table rotates from its generally upright use position in which one surface of the tray table forms a portion of the seat back seating surface to a generally horizontal position in which the opposite face of the tray table forms an upward facing work surface. This work surface is preferably a hard surface for writing. Once the tray table has been rotated about a first axis to this horizontal position, it is further rotatable about a second axis to swing the tray table laterally toward an adjacent seat assembly, such as the driver's seat. In a horizontal use position, the tray table can be used as a table to hold a fast food meal, as a work surface or, as a support surface for a laptop computer. The tray table is not limited to a horizontal use position but can be rotated about the first axis to various inclined positions. In an inclined use position, the tray table is useful as a map holder, placing a map in a more upright position for easier reading by the vehicle driver.

Further objects, features and advantages of the invention will become apparent from a consideration of the following description and the appended claims when taken in connection with the accompanying drawings.

DETAILED DESCRIPTION OF THE PREFERRED EMBODIMENT

Figure 1:
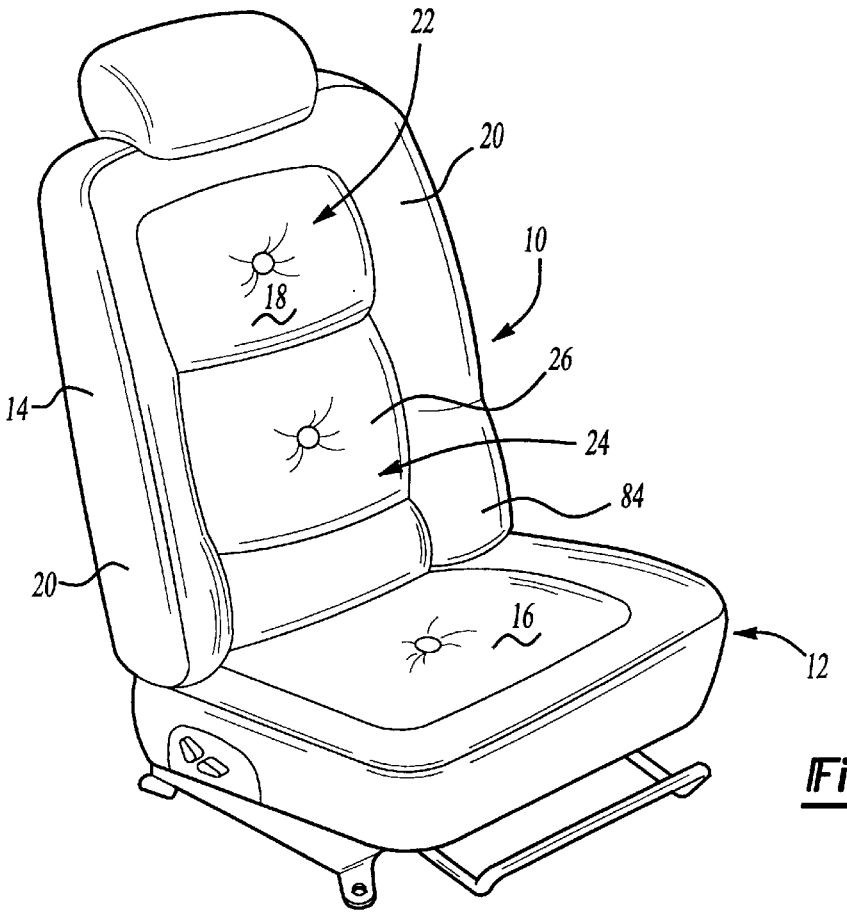
FIG. 1 is a perspective view of a vehicle seat assembly containing the tray table of the present invention in a stowed position.

With reference to FIG. 1, a seat assembly containing the tray table of the present invention is shown and designated generally at 10. The seat assembly 10 includes a generally horizontal seat bottom 12 and a seat back 14 which extends upwardly at the rear end of the seat bottom 12. The seat bottom 12 has an upper seat bottom seating surface 16 engaged by a seat occupant. Likewise, the seat back has a forward facing seat back seating surface 18 which is engaged by a seat occupant. The seating surface 18 of the seat back 14 is formed by a pair of side bolster portions 20 and a center portion 22 between the two side bolster portions 20.

Part of the center portion 22 of the seat back seating surface 18 is formed by a tray table 24. The tray table 24 has a stowed position within the seat back 14 in which the surface 26 of the tray table forms a part of the seat back seating surface 18. The tray table 24 is rotatable from the stowed position shown in FIG. 1 to a forwardly extending, generally horizontal use position shown in FIG. 2. There, a second surface 28 of the tray table is revealed which forms a generally horizontal work surface. The tray table 24 rotates about a generally horizontal axis 74 (FIG. 6) from the stowed position shown in FIG. 1 to the generally horizontal forwardly extending use position shown in FIG. 2.

Figure 2:
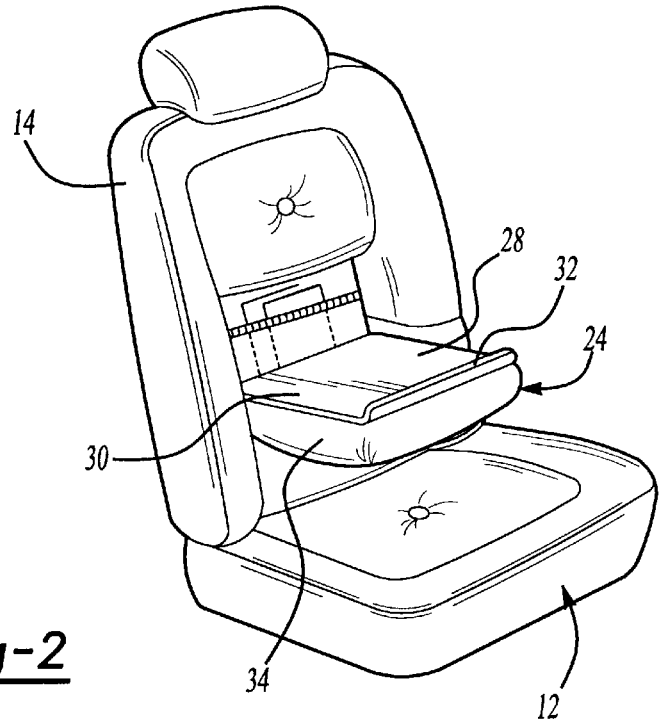
FIGS. 2, 3 and 4 are perspective views of the seat assembly shown in FIG. 1 with the tray table in three different use positions.
Figure 3:
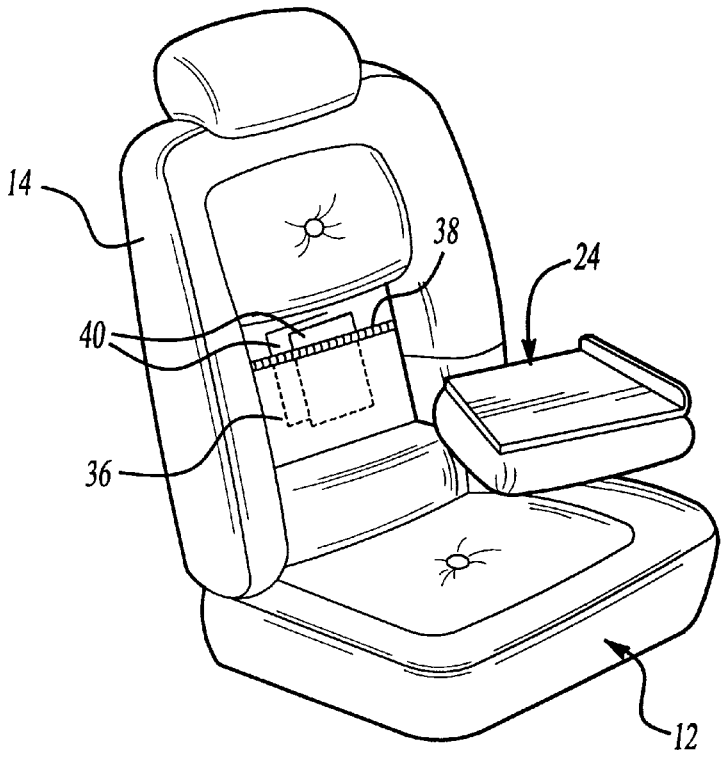
Figure 4:
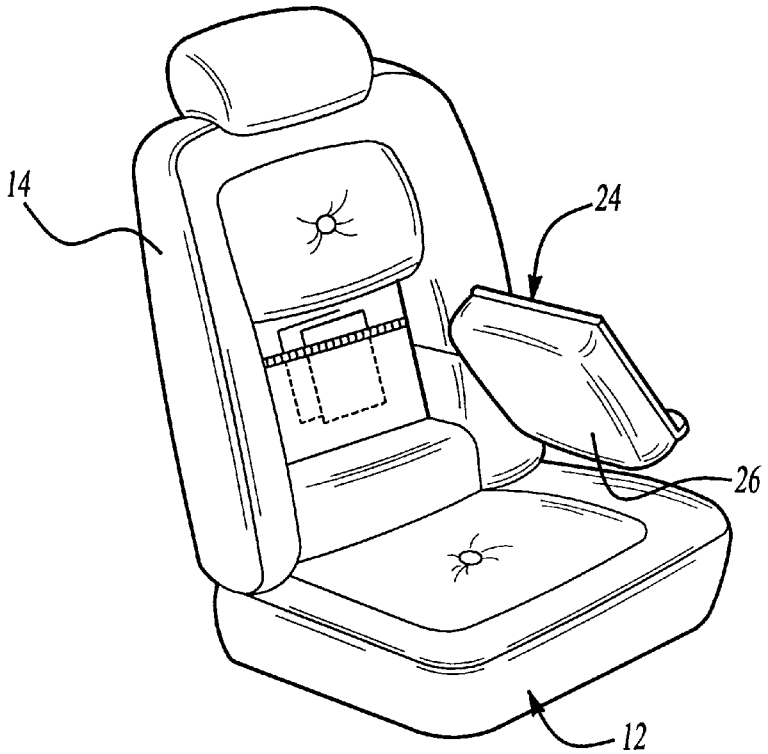

From the forwardly extending use position shown in FIG. 2, the tray table 24 can rotate about an upright axis 62 (FIG. 6) to swing the tray table laterally, toward an adjacent seat assembly. This laterally swung use position is shown in FIG. 3. The tray table 24 is not limited to use in the horizontal positions shown in FIGS. 2 and 3 but can be rotated further about the axis 74 to an inclined position shown in FIG. 4. In the inclined use position, the tray table 24 can be used to support a map in an upright orientation which is more easily viewed by a vehicle driver seated in the adjacent seat assembly.

The surface 28 of the tray table 24 is formed by a hard panel 30 to provide a hard writing surface. The hard panel 30 can have a raised lip 32 about one or more edges of the tray table 24 to help retain items placed thereon. The surface 26 of the tray table 24 is formed by a pad 34 attached to the hard panel 30 and covered with a suitable upholstery material to provide an attractive appearance, matching the remainder of the seat assembly 10 and providing comfort for a seat occupant.

The tray table 24 is disposed within a recess 36 in the seat back 14 when the tray table is in the stowed position. The seat upholstery in the recess 36 is formed with a pocket 38. The pocket 38 can be used to store maps or other generally flat items 40.

Figure 5:
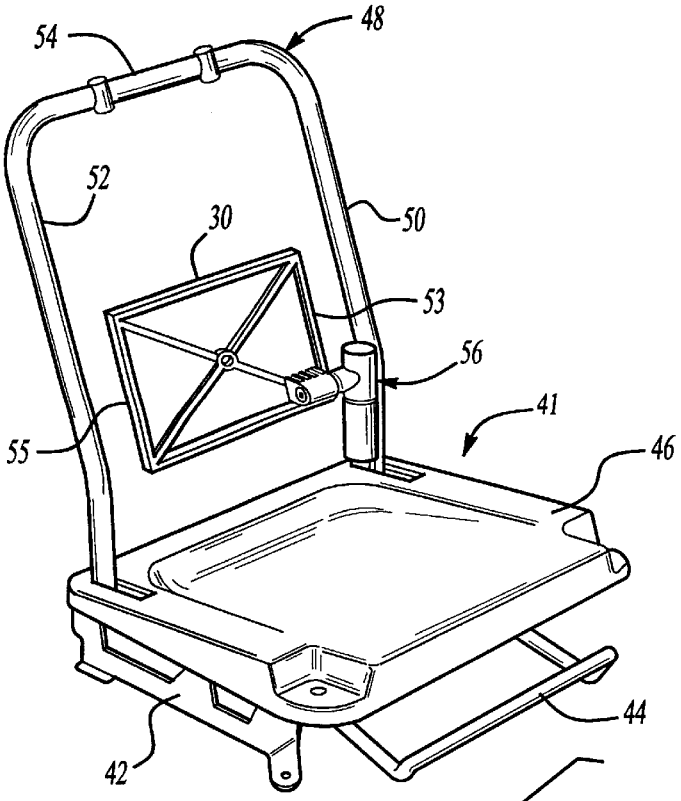
FIG. 5 is a perspective view of the frame of the seat assembly shown in FIG. 1 together with the multiple axis pivot mount for the tray table.

With reference to FIG. 5, the frame structure 41 of the seat assembly 10 is shown in greater detail. The frame structure 41 includes a pair of adjuster rails 42 on each side of the seat assembly 10 (only one pair is shown) to allow for fore and aft adjustment of the seat assembly in a conventional manner. A manual release bar 44 is provided at the front of the seat assembly to enable adjustment of the fore and aft seat position along the adjuster rails 42. The frame structure 41 further includes a seat bottom frame shown as a pan 46 which supports a pad of the seat bottom 12. The frame structure 41 includes an inverted U shaped seat back frame 48 having a pair of generally upright posts 50, 52 and an upper cross bar 54. The seat back frame 48 is typically mounted for rotation relative to the seat bottom 12 to adjust the recline angle of the seat back 14. The recliner mechanism is not shown, but any of a variety of recliner mechanisms can be used. Furthermore, the invention is not limited to use in a seat assembly having a reclinable seat back.

A multiple axis pivot mount 56 is attached to the post 50 of the seat back frame 48. The pivot mount 56 is shown in greater detail in FIG. 6. The pivot mount 56 includes a base portion 58 which is fixed to the seat frame 48. The base portion 58 includes a pivot post 60 which defines the generally upright axis 62 about which the tray table 24 rotates. A first pivot member 64 has a generally cylindrical bore 66 which receives the pivot post 60. A bolt or other fastener 68 retains the first pivot member 64 on the pivot post 60. The first pivot member 64 can rotate in both directions about the axis 62 as shown by the arrow 70.

A second pivot member 76 includes a bore 78 which receives the pivot post 72. A bolt or fastener 80 retains the second pivot member 76 on the pivot post 72. The hard panel 30 of the tray table 24 is fixed to the second pivot member 76 for rotation therewith about the axis 74. The hard panel 30 is preferably made of molded plastic or bent sheet metal but can be made of other generally rigid materials to provide a hard writing surface or support surface for the tray table 24. The second pivot member 76 and the tray table 24 rotate about the axis 74 as shown by the arrow 82.

The first pivot member 64 includes a laterally extending pivot post 72. The pivot post 72 extends generally perpendicular relative to the axis 62 and defines the axis 74, perpendicular to the axis 62. The axis 62 is generally upright but is not necessarily vertical. The direction of the axis 62 can vary with the recline angle of the seat back 14. In a preferred embodiment, the seat back 14 will have a given recline position, such as a foremost recline position, in which the axis 62 is vertical. In this position, the axis 74 will be horizontal for all positions of the first pivot member 64 about the axis 62. The first pivot member 64 is configured such that when the axis 74 extends laterally across the seat back, the axis 74 is horizontal so the tray table 24 aligns with and fits in the recess 36 regardless of the recline angle of the seat back 14.

The hard panel 30 has opposite side edges 53 and 55. The hard panel 30 is attached to the pivot mount 56 along one side edge 53 such that the tray table is cantilevered to the seat back frame 48 of the seat assembly 10. By virtue of the attachment along only one side edge of the tray table, the tray table 24 is able to swing laterally from the seat back 14. In a preferred embodiment, the pivot mount is attached to the inboard side edge of the tray table 24 so that when the tray table swings laterally, the tray table moves toward an adjacent seat assembly.

The second pivot member 76 and the pivot post 72 can be provided with detent mechanism to provide one or more detents to retain the tray table 24 in one or more positions about the axis 74. For example, a detent can be provided at the generally horizontal use position shown in FIGS. 2 and 3 and another detent at the inclined use position shown in FIG. 4. The detent mechanism can include a spring biased ball that extends from either of the pivot post 72 or second pivot member 76 and engage in a recess in the other of the pivot post 72 or pivot member 76 at fixed rotational positions of the second pivot member 76.

The tray table 24 of the present invention has been shown in an embodiment in which it is fixed to a seat back frame 48 by the multiple axis pivot mount 56. In a seat assembly in which the seat back recline angle is not adjustable, the multiple axis pivot mount 56 can be fixed to the seat bottom frame instead of being fixed to the seat back frame.

The tray table 24 has been shown in an embodiment in which it forms a portion of the seating surface 18 of the seat back 14. The tray table 24 could be incorporated into the rear surface of the seat back 14 and rotate rearward to provide a tray table for a rear seat occupant. The multiple axis pivot mount 56 can be used with such a rear tray table to enable the tray table to swing toward a person seated to the rear and to the side of the seat assembly containing the tray table.

The multiple axis pivot mount 56 is shown adjacent to the post 50 of the seat back frame 48 and attached thereto. The base portion 58 of the pivot mount can be incorporated directly into the post 50 of the seat back frame. In such an embodiment, the seat back frame post 50 would attach to an upper end of the pivot post 60 of the pivot mount base portion 58 and continue upwardly therefrom.

Figure 6:
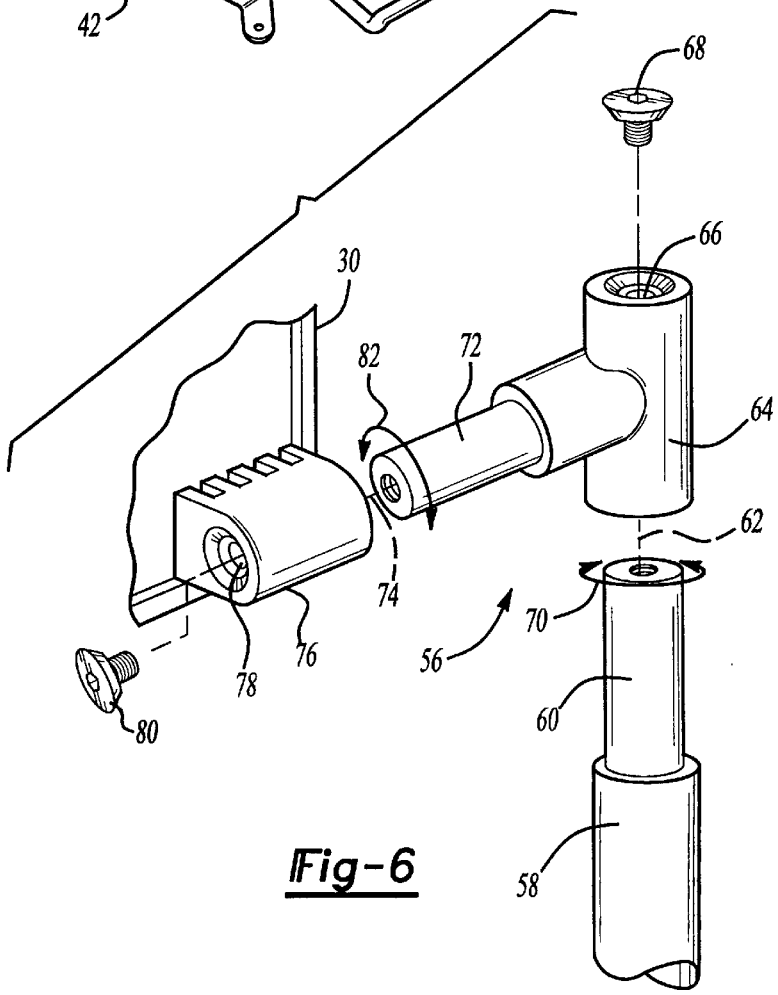
FIG. 6 is an exploded perspective view of the multiple axis pivot mount for the tray table.

Pivot mounting mechanisms other than the three piece mechanism shown in FIG. 6, can be used to mount the tray table 24. A ball and socket mechanism can be used to provide the multiple axis pivot motion to the tray table.

In the embodiment shown in FIG. 1, an upholstered pad 84 covers the lower portion of the seat back frame post 50 forming a lower section of the side bolster portion 20. The pad 84 also surrounds the base portion 58 of the pivot mount 56. The pad 84 rotates with the tray table 24 about the axis 62.

The tray table of the present invention provides added convenience to the vehicle user, particularly to the vehicle driver, by providing a tray table that can be rotated toward the driver's seat and which can be inclined to hold maps or similar items at a more upright and easily viewed position. The tray table of the invention is not limited to a front passenger seat assembly but could be included in a rear seat assembly as well.

It is to be understood that the invention is not limited to the exact construction illustrated and described above, but that various changes and modifications may be made without departing from the spirit and scope of the invention as defined in the following claims.

We claim:

1. A seat assembly comprising:

a frame structure;

a seat bottom supported by said frame structure having a generally horizontal seat bottom seating surface, said seat bottom having a rear end;

a seat back supported by said frame structure, said seat back extending upwardly from said rear end of said seat bottom and having a seat back seating surface, said seat bottom seating surface and said seat back seating surface being engaged by a seat occupant;

a tray table having a stowed position within said seat back; and a pivot mount having a generally vertical pivot axis fixed relative to said frame structure, said pivot mount attaching said tray table to said frame structure for rotation of said tray table relative to said seat back about two non-parallel axes from said stowed position to one or more use positions.

2. The seat assembly as defined by claim 1 wherein said two axes are normal to one another.

3. The seat assembly as defined by claim 2 wherein one of said two axes is substantially horizontal when said tray table is in said stowed position.

4. The seat assembly as defined by claim 1 wherein said tray table rotates about a first of said two axes from said stowed position to a horizontal use position and rotates about a second of said two axes to swing laterally relative to said seat back.

5. The seat assembly as defined by claim 1 wherein said tray table rotates about a first of said two axes from said stowed position to an inclined use position.

6. The scat assembly as defined by claim 1 wherein said tray table has opposite side edges and said pivot mount is coupled to said tray table adjacent one of said side edges to cantilever support said tray table.

7. The seat assembly as defined by claim 1 wherein said frame structure includes a seat back frame and said pivot mount is attached to said seat back frame to mount said tray table thereto.

8. The seat assembly as defined by claim 1 wherein said seat back seating surface is formed in part by a first surface of said tray table.

9. The seat assembly as defined by claim 8 wherein a second surface of said tray table opposite said first surface forms a hard writing surface.

10. The seat assembly as defined by claim 9 wherein said tray table rotates forward and downward from said stowed position to said use position whereby said hard writing surface becomes a top surface.

11. The seat assembly as defined by claim 1 wherein said seat back seating surface has a center portion and opposite side portions and said tray table has a first surface which forms at least part of said center portion of said seat back seating surface.

12. The seat assembly as defined by claim 1 wherein said seat back includes a recess into which said tray table is disposed when said tray table is in said stowed position and wherein said seat back has an upholstery cover in said recess forming a storage pocket.

13. A seat assembly comprising:

a frame structure;

a seat bottom supported by said frame structure having a generally horizontal seat bottom seating surface, said seat bottom having a rear end;

a seat back supported by said frame structure, said seat back extending upwardly from said rear end of said seat bottom and having a seat back seating surface, said seat back seating surface having a first side portion and a second side portion, said seat bottom seating surface and said seat back seating surface being engaged by a seat occupant;

a tray table having a stowed position within said seat back, wherein a first surface of said tray table forms at least a part of said seat back seating surface between said first side portion and said second side portion, said tray table having opposite side edges; and a single cantilevered pivot mount attaching said tray table to said frame structure adjacent one of said side edges of said tray table to cantilever support said tray table as said tray table is folded in a forward direction and rotated about two axes from said stowed position to one or more use positions.

14. The seat assembly as defined by claim 13 wherein said opposite side edges of said tray table include an inboard side edge and an outboard side edge and said pivot mount is adjacent said inboard edge of said tray table.

15. The seat assembly as defined by claim 13 wherein said pivot mount enables rotation of said tray table from said stowed position about a first axis to a use position in which said tray table extends generally horizontally forward from said seat back.

16. The seat assembly as defined by claim 15 wherein said pivot mount enables rotation of said tray table about a second axis normal to said first axis.

17. The seat assembly as defined by claim 13 wherein said frame structure includes a seat back frame and said pivot mount is attached to said seat back frame.

18. The seat assembly as defined by claim 13 wherein said seat back seating surface is formed in part by a first surface of said tray table.

19. The seat assembly as defined by claim 18 wherein a second surface of said tray table opposite said first surface forms a hard writing surface.

20. The seat assembly as defined by claim 13 wherein said seat back seating surface has a center portion and said first surface of said tray table forms at least a part of said center portion of said seat back seating surface.

21. The seat assembly as defined by claim 13 wherein said seat back includes a recess into which said tray table is disposed when said tray table is in said stowed position and wherein said seat back has an upholstery cover in said recess forming a storage pocket.

22. A seat assembly comprising:

a seat bottom having a generally horizontal seat bottom seating surface and a rear end;

a seat back extending upwardly from said rear end of said seat bottom and having a seat back seating surface;

a frame structure including a seat back frame with opposite side posts and an upper cross member at upper ends of said side posts, said frame structure supporting said seat back;

a tray table having a stowed position within said seat back; and a pivot mount having a generally vertical pivot axis fixed relative to said frame structure, said pivot mount attaching said tray table to one of said side posts of said seat back frame for rotation of said tray table relative to said seat back about two non-parallel axes from said stowed position to one or more use positions.

23. The seat assembly as defined by claim 22 wherein said pivot mount includes:

a base portion fixed to said one side post of said seat back frame and having a first pivot post defining a first pivot axis;

a first pivot member mounted on said first pivot post for rotation about said first pivot axis, said first pivot member including a second pivot post defining a second pivot axis; and a second pivot member mounted on said second pivot post for rotation about said second pivot axis, said second pivot member being attached to said tray table whereby said tray table rotates with said second pivot member about said first and second pivot axes.

24. A seat assembly comprising:

a seat bottom having a generally horizontal seat bottom seating surface;

a seat back extending upwardly relative to said seat bottom and having a seat back seating surface;

a frame structure supporting at least one of said seat bottom and said seat back;

a tray table having a stowed position within said seat back; and a pivot mount having a generally vertical pivot axis fixed relative to said frame structure, said pivot mount attaching said tray table to said frame structure for rotation of said tray table about two non-parallel axes from said stowed position to one or more use positions.

25. The seat assembly as defined by claim 24 wherein said seat back has a first side portion and a second side portion, and a first surface of said tray table forms at least a part of said seat back seating surface between said first side portion and said second side portion.

26. A seat assembly comprising:

a seat bottom having a generally horizontal seat bottom seating surface;

a seat back extending upwardly relative to said seat bottom, said seat back having a seat back seating surface, said seat back seating surface having a first side portion and a second side portion;

a frame structure supporting at least one of said seat bottom and said seat back;

a tray table having a stowed position within said seat back, said tray table having a first surface, said first surface of said tray table forming at least a part of said seat back seating surface between said first side portion and said second side portion; and a pivot mount attaching said tray table to said frame structure for rotation of said tray table about two non-parallel axes from said stowed position to one or more use positions.

27. The seat assembly as defined by claim 26 wherein said pivot mount has a generally vertical pivot axis fixed relative to said frame structure.

* * * * *